US007540795B2

(12) United States Patent
Okuyama et al.

(10) Patent No.: US 7,540,795 B2
(45) Date of Patent: Jun. 2, 2009

(54) WATERCRAFT PROPULSION APPARATUS AND WATERCRAFT

(75) Inventors: Takashi Okuyama, Shizuoka (JP); Noriyoshi Ichikawa, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 62 days.

(21) Appl. No.: 11/686,134

(22) Filed: Mar. 14, 2007

(65) Prior Publication Data

US 2007/0218785 A1 Sep. 20, 2007

(30) Foreign Application Priority Data

Mar. 14, 2006 (JP) ..... 2006-068575

(51) Int. Cl.
*B63H 21/21* (2006.01)

(52) U.S. Cl. ..... 440/85; 440/1; 701/21

(58) Field of Classification Search ..... 440/1, 440/75, 84, 85, 86, 87; 60/702, 706; 701/21, 701/36

See application file for complete search history.

(56) References Cited

U.S. PATENT DOCUMENTS

| | | | |
|---|---|---|---|
| 1,843,272 | A | 2/1932 | Evinrude |
| 2,204,265 | A | 6/1940 | Wentzel |
| 2,466,282 | A | 4/1949 | Sparrow et al. |
| 2,740,260 | A | 4/1956 | Blanchard |
| 3,986,363 | A | 10/1976 | Beaman et al. |
| 4,412,422 | A | 11/1983 | Rossi |
| 4,622,938 | A | 11/1986 | Wenstadt et al. |
| 4,646,696 | A | 3/1987 | Dogadko |
| 4,648,697 | A | 3/1987 | Kawazoe |
| 4,747,381 | A | 5/1988 | Baltz et al. |
| 4,755,156 | A | 7/1988 | Wagner |
| 4,788,955 | A | 12/1988 | Wood |
| 4,801,282 | A | 1/1989 | Ogawa |
| 4,805,396 | A | 2/1989 | Veerhusen et al. |

(Continued)

FOREIGN PATENT DOCUMENTS

| | | |
|---|---|---|
| JP | 03-061196 | 3/1991 |

(Continued)

OTHER PUBLICATIONS

Product catalog of i6000TEC—Triple Engine Electronic Shift & throttle of Teleflex Morse Co., Ltd. (USA), Jul. 2000.

(Continued)

*Primary Examiner*—Lars A Olson
(74) *Attorney, Agent, or Firm*—Knobbe, Martens, Olson & Bear, LLP

(57) ABSTRACT

An outboard motor of a watercraft can include a shifting mechanism for performing gear shifting among forward, neutral, and reverse positions. A shift actuator can be configured to drive the shifting mechanism. A shift position sensor can be configured to detect a position of the shift actuator with respect to the forward, neutral, and reverse positions. A controller can be configured to control the shift actuator in accordance with a signal provided from the shift position sensor. A start-regulation circuit can have a plurality of semiconductor devices configured to deactivate a starting motor of the engine when a starting switch of the engine is turned on in a state where a position other than neutral is detected by the shift position sensor.

17 Claims, 8 Drawing Sheets

U.S. PATENT DOCUMENTS

| | | | | |
|---|---|---|---|---|
| 4,809,506 | A | 3/1989 | Lauritsen | |
| 4,810,216 | A | 3/1989 | Kawamura | |
| 4,836,809 | A | 6/1989 | Pelligrino | |
| 4,850,906 | A | 7/1989 | Kanno et al. | |
| 4,858,585 | A | 8/1989 | Remmers | |
| 4,898,045 | A | 2/1990 | Baba | |
| 4,964,276 | A | 10/1990 | Sturdy | |
| 5,004,962 | A | 4/1991 | Fonss et al. | |
| 5,051,102 | A | 9/1991 | Onoue | |
| 5,062,403 | A | 11/1991 | Breckenfeld et al. | |
| 5,062,516 | A | 11/1991 | Prince | |
| 5,065,723 | A | 11/1991 | Broughton et al. | |
| 5,103,946 | A | 4/1992 | Masters et al. | |
| 5,144,300 | A * | 9/1992 | Kanno | 440/85 |
| 5,157,956 | A | 10/1992 | Isaji et al. | |
| 5,167,212 | A | 12/1992 | Peter et al. | |
| 5,273,016 | A | 12/1993 | Gillespie et al. | |
| 5,318,466 | A | 6/1994 | Nagafusa | |
| 5,352,138 | A * | 10/1994 | Kanno | 440/86 |
| 5,381,769 | A | 1/1995 | Nishigaki et al. | |
| 5,492,493 | A | 2/1996 | Ohkita | |
| 5,539,294 | A | 7/1996 | Kobayashi | |
| 5,595,159 | A | 1/1997 | Huber et al. | |
| 5,664,542 | A | 9/1997 | Kanazawa et al. | |
| 5,730,105 | A | 3/1998 | McGinnity | |
| 5,749,343 | A | 5/1998 | Nichols et al. | |
| 5,771,860 | A | 6/1998 | Bernardi | |
| 5,782,659 | A | 7/1998 | Motose | |
| 5,899,191 | A | 5/1999 | Rabbit et al. | |
| 6,015,319 | A | 1/2000 | Tanaka | |
| 6,026,783 | A | 2/2000 | Nestvall et al. | |
| 6,058,349 | A | 5/2000 | Kikori et al. | |
| 6,073,509 | A | 6/2000 | Salecker et al. | |
| 6,073,592 | A | 6/2000 | Brown et al. | |
| 6,095,488 | A | 8/2000 | Semeyn, Jr. et al. | |
| 6,098,591 | A | 8/2000 | Iwata | |
| 6,109,986 | A | 8/2000 | Gaynor et al. | |
| 6,233,943 | B1 | 5/2001 | Beacom et al. | |
| 6,273,771 | B1 | 8/2001 | Buckley et al. | |
| 6,280,269 | B1 | 8/2001 | Gaynor | |
| 6,351,704 | B1 | 2/2002 | Koerner | |
| 6,379,114 | B1 | 4/2002 | Schott et al. | |
| 6,382,122 | B1 | 5/2002 | Gaynor et al. | |
| 6,414,607 | B1 | 7/2002 | Gonring et al. | |
| 6,485,340 | B1 * | 11/2002 | Kolb et al. | 440/84 |
| 6,587,765 | B1 | 7/2003 | Graham et al. | |
| 6,612,882 | B2 | 9/2003 | Shidara et al. | |
| 6,658,960 | B2 * | 12/2003 | Babin et al. | 74/473.28 |
| 6,704,643 | B1 | 3/2004 | Suhre et al. | |
| 6,751,533 | B2 | 6/2004 | Graham et al. | |
| 6,910,927 | B2 | 6/2005 | Kanno | |
| 6,923,696 | B2 * | 8/2005 | Okuyama | 440/85 |
| 6,965,817 | B2 | 11/2005 | Graham et al. | |
| 7,121,908 | B2 | 10/2006 | Okuyama | |
| 7,142,955 | B1 | 11/2006 | Kern et al. | |
| 7,153,174 | B2 | 12/2006 | Takeda et al. | |
| 7,220,153 | B2 | 5/2007 | Okuyama | |
| 2003/0082962 | A1 | 5/2003 | Kanno | |
| 2003/0092331 | A1 | 5/2003 | Okuyama | |
| 2003/0093196 | A1 | 5/2003 | Okuyama | |
| 2004/0029461 | A1 | 2/2004 | Shomura | |
| 2005/0118895 | A1 | 6/2005 | Kanno et al. | |
| 2005/0245145 | A1 | 11/2005 | Takada et al. | |
| 2005/0286539 | A1 | 12/2005 | Okuyama | |
| 2006/0240720 | A1 | 10/2006 | Yamashita et al. | |
| 2007/0082565 | A1 | 4/2007 | Okuyama | |
| 2007/0082566 | A1 | 4/2007 | Okuyama | |
| 2007/0178780 | A1 | 8/2007 | Ito et al. | |

FOREIGN PATENT DOCUMENTS

| | | |
|---|---|---|
| JP | 2001-260986 | 9/2001 |
| JP | 2003-098044 | 4/2003 |
| JP | 2003-127986 | 5/2003 |
| JP | 2003-146293 | 5/2003 |
| JP | 2004-068704 | 3/2004 |
| JP | 2004-208452 | 7/2004 |
| JP | 2004-244003 | 9/2004 |
| JP | 2005-272352 | 9/2005 |
| JP | 2005-297785 | 10/2005 |
| JP | 2006-068575 | 3/2006 |
| JP | 2006-074794 | 3/2006 |
| JP | 2006-076871 | 3/2006 |
| JP | 2006-087325 | 4/2006 |
| JP | 2006-115305 | 4/2006 |
| JP | 2006-118039 | 5/2006 |
| JP | 2006-154480 | 6/2006 |
| JP | 2006-156526 | 6/2006 |
| WO | WO 2005-102833 | 11/2005 |

OTHER PUBLICATIONS

U.S. Appl. No. 11/731,691, filed Mar. 30, 2007, entitled Remote Control System for a Watercraft.
U.S. Appl. No. 11/731,057, filed Mar. 30, 2007, entitled Remote Control Unit for a Boat.
U.S. Appl. No. 11/731,422, filed Mar. 30, 2007, entitled Remote Control System for a Boat.
U.S. Appl. No. 11/731,086, filed Mar. 30, 2007, entitled Remote Control Device for a Boat.
U.S. Appl. No. 11/731,681, filed Mar. 30, 2007, entitled Remote Control Appratus for a Boat.
U.S. Appl. No. 11/688,127, filed Mar. 19, 2007, entitled Remote Control Device, Remote Control Device Side ECU and Watercraft, Now published as US-2007-0232162-A1.
U.S. Appl. No. 11/688,818, filed Mar. 20, 2007, entitled Remote Control Device and Watercraft.
U.S. Appl. No. 11/728,819, filed Mar. 27, 2007, entitled Boat Having Prioritized Controls, Now published as US-2007-0227429-A1.
Barron, Jim. "Get on the Bus." Trailer Boats Magazine, Jun. 2000, p. 36.
Spisak, Larry. "Know it by Chart." Boating Magazine, May 2000, p. 100.
J.D. "Gains in technology will alter makeup of the . . . " Boating Industry International, Nov. 2000.
Declaration of Daniel J. Carr, Jun. 4, 2001.
Denn, James. "Future boats sales will hinge on technology." Boating Industry International, Nov. 2000.
Hemmel, Jeff. "Information, Please—The digital boating revolution begins." Boating Magazine, Sep. 2000.
Kelly, Chris. "Can We Talk?" Power & Motoryacht Magazine, Jun. 2000, pp. 36 & 38, 39.
"Plug and Play" Advertisement from "Motorboating", Dec. 2000, p. 57.
"MagicBus™ i3000 Series Intelligent Steering" Instruction Manual. Telefex, Inc, 2000.

* cited by examiner

| SPS | Input voltage (example) | Output |
|---|---|---|
| Failed | 4.5V or higher | Hi |
| F (N-F intermediate zone) | 3~4.5V | Hi |
| N (N-R intermediate zone) | 2~3V | Lo |
| R | 0.5~2V | Hi |
| Failed | 0.5V or lower | Hi |

*Figure 7*

| State | Output |
|---|---|
| Initialized | Lo |
| Normal operation | Lo |
| Cranking inhibited | Hi |

*Figure 8*

| Input (1) | Input (2) | Output |
|---|---|---|
| Lo | Lo | Hi |
| Lo | Hi | Lo |
| Hi | Lo | Lo |
| Hi | Hi | Lo |

*Figure 9*

| Cranking command | Out-put |
|---|---|
| Initialized | Lo |
| Not to be issued | Lo |
| To be issued | Hi |

*Figure 10*

| Input (1) | Input (2) | Output |
|---|---|---|
| Lo | SWOFF | Lo |
| Lo | SWON | Hi |
| Hi | SWOFF | Hi |
| Hi | SWON | Hi |

*Figure 11*

| Input (1) | Input (2) | Output |
|---|---|---|
| Lo | Lo | Relay open |
| Lo | Hi | Relay open |
| Hi | Lo | Relay open |
| Hi | Hi | Relay closed |

*Figure 12*

WATERCRAFT PROPULSION APPARATUS AND WATERCRAFT

PRIORITY INFORMATION

This application is based on and claims priority to Japanese Patent Application No. 2006-068575, filed Mar. 14, 2006, the entire contents of which is hereby expressly incorporated by reference.

BACKGROUND OF THE INVENTIONS

1. Field of the Inventions

The present inventions relate to watercraft propulsion apparatuses having engines that produce thrust under control of a remote control device, and to a watercraft having such propulsion apparatuses. The remote control device can be operated using a shift lever, and can electrically and remotely control shifting among forward, neutral, and reverse modes.

2. Description of the Related Art

Conventionally, many watercraft include a neutral switch that prevents the watercraft's engine from starting when a gear shift system is not in a neutral position; that is, when the gear shift system is engaged or "in gear". When such a gear shift system is in its neutral position, the neutral switch outputs a signal. When this signal is output, the engine is allowed to start. On the other hand, the engine is prevented from starting when the gear shift system is in a gear position other than neutral, thereby preventing abrupt movements that may result if the engine were started in gear.

Japanese Patent Document JP-A-2005-297785 discloses a watercraft provided with a remote controller for electrically and remotely controlling shifting operations between forward, neutral, and reverse modes by operating a shift lever. This remote control system runs a program to detect an angular position of the shift lever, and to transmit a signal indicating the detected angular position to an ECU (electronic control unit) of an associated outboard motor. The ECU activates a shift actuator, which actuates a dog clutch to carry out a shifting operation.

In this system, when the engine is stopped in gear and the shift lever is then later moved to the neutral position, the gear shift system remains in gear because the shift lever and the shift actuator are not mechanically connected. As such, it is possible for the engine to be started while the shift system is in gear even though the shift lever is set to the neutral position. In this case, an operator may erroneously believe the gear shift system is in neutral on the basis of the position of the shift lever, and operate an ignition switch so as to start the engine, which results in cranking in gear.

Japanese Patent Document JP-A-2004-244003 discloses a neutral switch for transmitting a neutral signal to an electrically-operated actuator. In this system, the engine can be started in accordance with the neutral signal.

SUMMARY OF THE INVENTIONS

Systems that include a neutral detection device in the gear shift system require the additional installation of a neutral safety switch mechanism for detecting a neutral state, which requires additional space therefor. In addition, when a determination as to whether to permit engine starting according to on the basis of on a neutral signal is made by software, the responsiveness of engine starting to an operation with an engine starting switch is unfavorable. For example, as noted above, a user may move the shift lever to the neutral position after the engine has been stopped with the gear shift system in gear. Then, a user might attempt to re-start the engine before the software can shift the gear shift system into the neutral position in accordance with the position of the shift lever.

Thus, in accordance with an embodiment, a watercraft propulsion system can have an engine configured to produce thrust under control of a remote controller that remotely controls shifting between forward, neutral, and reverse modes. The watercraft propulsion apparatus can comprise a shifting mechanism configured to shifting gears between forward, neutral, and reverse gears, a shift actuator configured to drive the shifting mechanism, a shift position sensor configured to detect a position of the shift actuator with respect to the forward, neutral, and reverse gears, and a controller configured to control the shift actuator in accordance with a signal provided from the shift position sensor. A start-regulation circuit can include a plurality of semiconductor devices, the circuit being configured to deactivate a starter of the engine when a starting switch of the engine is turned on in a state where a position other than neutral is detected by the shift position sensor.

In accordance with another embodiment, a watercraft propulsion system can have an engine configured to produce thrust under control of a remote controller that remotely controls shifting between forward, neutral, and reverse modes. The watercraft propulsion apparatus can comprise a shifting mechanism configured to shifting gears between forward, neutral, and reverse gears, a shift actuator configured to drive the shifting mechanism, a shift position sensor configured to detect a position of the shift actuator with respect to the forward, neutral, and reverse gears, and a controller configured to control the shift actuator in accordance with a signal provided from the shift position sensor. Additionally, the system can include a start-regulation circuit including a plurality of semiconductor devices, the circuit including means for deactivating a starter of the engine when a starting switch of the engine is turned on in a state where a position other than neutral is detected by the shift position sensor.

BRIEF DESCRIPTION OF THE DRAWINGS

The above-mentioned and other features of the inventions disclosed herein are described below with reference to the drawings of the preferred embodiments. The illustrated embodiments are intended to illustrate, but not to limit the inventions. The drawings contain the following Figures.

FIG. 7 is a table showing exemplary relationships between input voltage values and outputs that can be used with a window comparator according to an embodiment.

FIG. 8 is a table showing exemplary relationships between states and outputs that can be used with a cranking-permission/inhibition section according to an embodiment.

FIG. 9 is a table showing exemplary relationships between inputs and outputs that can be associated with a NOR circuit according to an embodiment.

FIG. 10 is a table showing exemplary relationships between states related to a cranking command and outputs of a cranking commanding section according to an embodiment.

FIG. 11 is a table showing exemplary relationships between inputs and outputs that can be associated with an OR circuit according to an embodiment.

FIG. 12 is a table showing exemplary relationships between inputs and outputs that can be associated with an AND circuit according to an embodiment.

DETAILED DESCRIPTION OF THE PREFERRED EMBODIMENT

Improved boats and remote control systems for boats are disclosed herein. Although the present boats and remote control systems are illustrated and described in the context of an outboard motor-powered boat, the present inventions can be used with other types of remote control systems and other types of vehicles.

Figure 1:
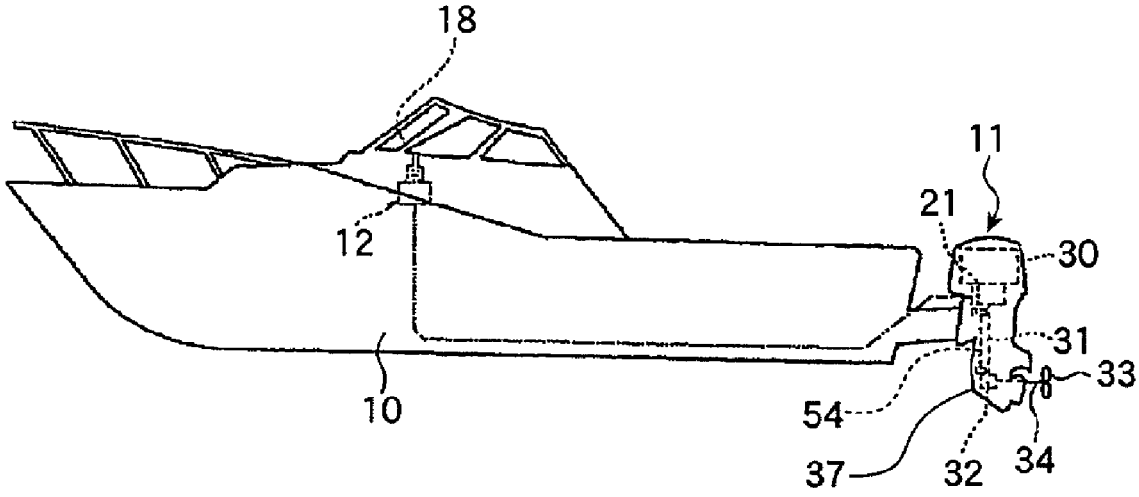
FIG. 1 is a schematic side elevational view of a watercraft according to an embodiment.
Figure 2:
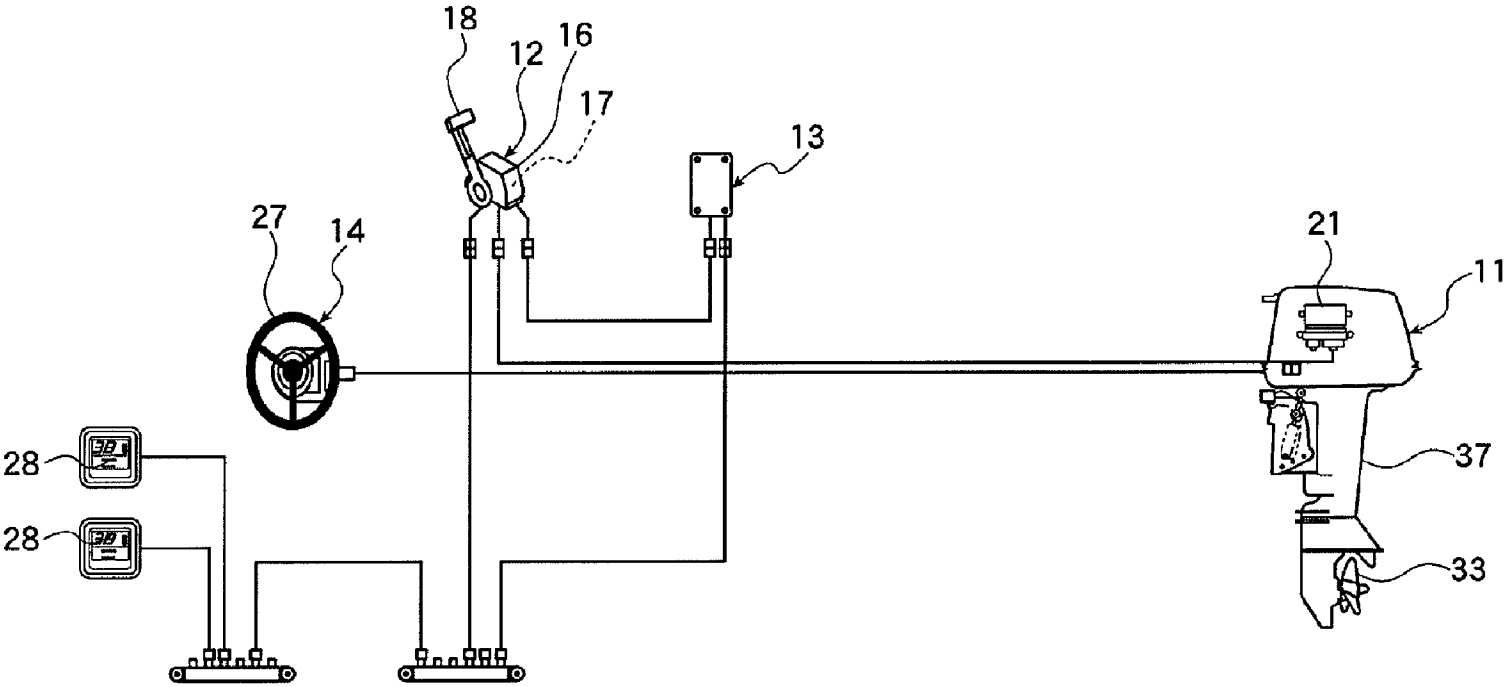
FIG. 2 is a block diagram showing an embodiment of a propulsion system for a watercraft having a remote controller, a key switch device, and an outboard motor.

As shown in FIGS. 1 and 2, a watercraft can include a hull 10. An outboard motor 11, serving as a watercraft propulsion apparatus, can be attached to the stem of the hull 10. The outboard motor 11 can be controlled and operated using a remote controller 12, a key switch unit 13, a steering unit 14, and the like, that are disposed in a cockpit of the hull 10.

Figure 5:
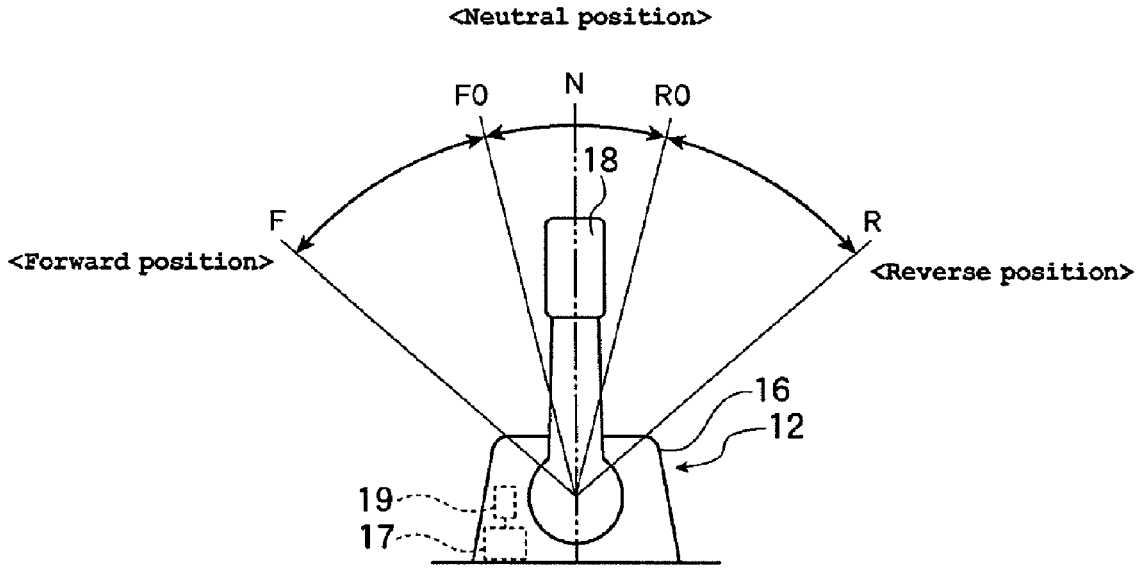
FIG. 5 is a schematic side elevational view of a shift lever according to the embodiment.

The remote controller 12 incorporates a remote-controller ECU 17 in a remote controller body 16, and can comprise a shift lever 18 for performing throttle and shifting operations. By operating the shift lever 18, shifting among forward, neutral, and reverse modes can be remotely effected. As shown in FIG. 5, when the shift lever 18 is upright at the center, the lever 18 is in a neutral position (N); when tilted forward from the neutral position by a predetermined angle, the lever 18 is in a forward position (F); and when tilted rearward from the neutral position by a predetermined angle, the lever 18 is in a reverse position (R). Information on the speed and angle of the operation with the shift lever 18 can be detected by a potentiometer 19 and transmitted to the remote-controller ECU 17.

Figure 6:
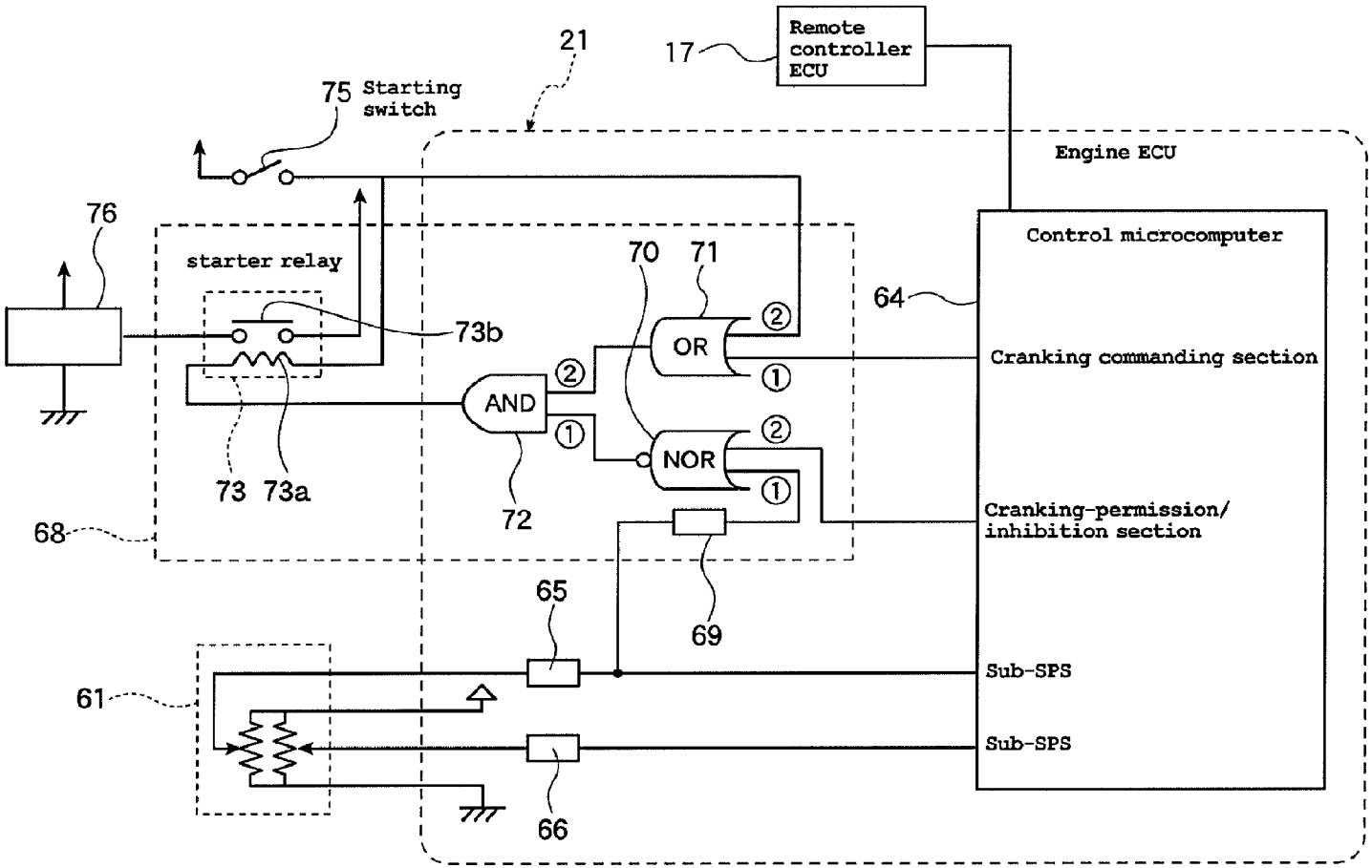
FIG. 6 is a block diagram of a remote controller ECU, an engine ECU, and other associated components according to the embodiment.

As shown in FIG. 6, a signal provided from the remote controller ECU 17 can be transmitted to an engine ECU 21 of the outboard motor 11. The engine ECU 21 controls a shift motor 25 of a shift actuator 22 in accordance with a displacement of the shift lever 18. The shift actuator 22 actuates a shifting mechanism 23, thereby performing gear shifting among the forward, neutral, and reverse modes.

As shown in FIG. 2, the key switch unit 13 can be connected to the remote controller ECU 17 of the remote controller 12. The key switch unit 13 can have a starting switch 75 (see FIG. 6) and a main/stop switch (not shown).

The steering unit 14 can incorporate a steering ECU (not shown) and a steering wheel 27 for use in a steering operation. The position of the steering wheel 27 can be detected by a position sensor, which can be connected to the steering ECU by way of a signal circuit.

The steering ECU of the steering unit 14 can be connected to the engine ECU 21 by way of a DBW CAN cable serving as a signal line. "Drive-by-wire," or "DBW," referred to herein is a controller for performing control processes using electrical signals in place of conventional mechanical connections. The term "CAN" is an abbreviation for "controller area network."

Each of reference numerals 28 in FIG. 2 denotes a gauge, which can be a multimeter-type gauge that can display various data such as, for example, but without limitation, engine speed, boat speed, fuel level, etc.

As shown in FIG. 1 and other drawings, an engine 30 can be disposed in an upper portion of the outboard motor 11. Output of the engine 30 can be transmitted to a propeller shaft 34 by way of a drive shaft 31 and a shift system 32. A propeller 33 can be fixed to the propeller shaft 34.

Gear shifting between the forward, neutral, and reverse positions in the shift system 32 can be carried out by the shifting mechanism 23. The shifting mechanism 23 can be actuated by the shift actuator 22.

Figure 3:
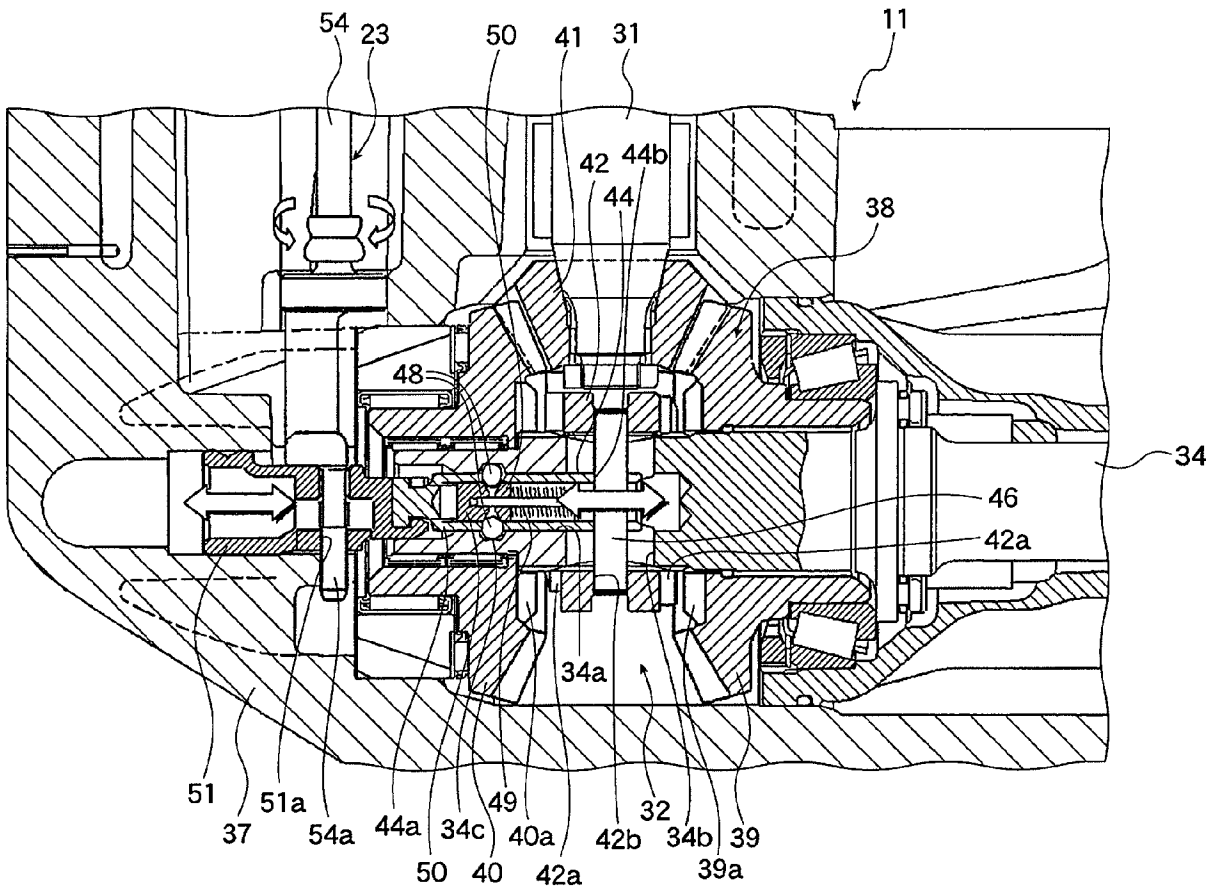
FIG. 3 is a cross-sectional view of a portion of a gear shift system of the watercraft according to the embodiment.

For example, in some embodiments, as shown in FIGS. 1 to 3, the outboard motor 11 can have the propeller 33 attached to the propeller shaft 34. The propeller shaft 34 can extend generally horizontally in a casing 37. The propeller shaft 34 can be connected to the drive shaft 31 through a shift gearing 30 for changing between forward and reverse propulsion; that is, for gear shifting.

The shift gearing 30 can have a forward gear 39 and a reverse gear 40, both of which are rotatably attached to the propeller shaft 34. Both of the gears 39 and 40 mesh with a pinion 41 fixed to the drive shaft 31, which can be driven to rotate clockwise as seen from above, thereby rotating the gears 39 and 40 in opposite directions relative to each other.

The forward gear 39 can be disposed at a rear side as viewed from the forward-advancing direction (leftward in FIG. 3) of the watercraft, while the reverse gear 40 can be disposed at a front side as viewed from the same.

A sleeve-shaped dog clutch 42 can be engaged with splines to the outer surface of the propeller shaft 34 at a position between the gears 39 and 40 so that the dog clutch 42 can be slidable in the axial direction of the propeller shaft 34. The dog clutch 42 has cogs 42*a*, both projecting in opposite directions from an axial end of the clutch 42. The gears 39 and 40 have cogs 39*a* and 40*a*, respectively, which face the cogs 42*a*. This structure can be considered as forming a meshing clutch.

The propeller shaft 34 can have, at its front end, an insertion hole 34*a* having an open front end along the axial direction. A shift sleeve 44 can be inserted into the insertion hole 34*a* so as to be axially slidable. An elongated hole 34*b*, which can be elongated in the axial direction of the shaft 34, can be formed in the side wall of the insertion hole 34*a* of the propeller shaft 34.

A through hole 42*b*, 44*b* can be formed along the diametral direction through the shift sleeve 44 and the dog clutch 42. A pin 46 can be inserted through a through hole 42*b* in the dog clutch 42, the elongated hole 34*b* in the propeller shaft 34, and a through hole 44*b* in the shift sleeve 44.

With this configuration, as the shift sleeve 44 moves, the pin 46 can be axially moved within the range of the elongated hole 34*b*, and hence the dog clutch 42 can be moved in the axial direction of the propeller shaft 34 linked with the pin 46. However, other configurations can also be used.

Detent balls 48 can be disposed in the shift sleeve 44 so as to be capable of protruding from or retracting into the outer surface of the shift sleeve 44. The detent balls 48 can be detachably engaged into a recess 34*c* in the propeller shaft 34. The detent balls 48 are urged by a spring 49 and a pressing member 50 in the protruding direction.

A shift slider 51 can be connected to a front end portion 44*a* of the shift sleeve 44 so as to be slidable in the lateral direction in FIG. 3. An engagement groove 51*a*, which can extend in the vertical direction, can be formed in the shift slider 51.

At the lower end of a shift shaft 54 of the shift device 23, a drive pin 54*a*, which can be disposed at a position offset from the rotary axis of the shift shaft 54 so as to form a crank, can be inserted in the engagement groove 51*a*. As the shift shaft 54 rotates, the drive pin 54*a* can be eccentrically rotated, thereby causing the shift slider to slide and hence causing the dog clutch 42 to slide.

Thus, clockwise rotation of the shift shaft 54 causes the dog clutch 42 to slide in a corresponding direction, while counterclockwise rotation of the shift shaft 54 causes the dog clutch 42 to slide in the direction opposite thereto. However, other configurations can also be used.

Figure 4:
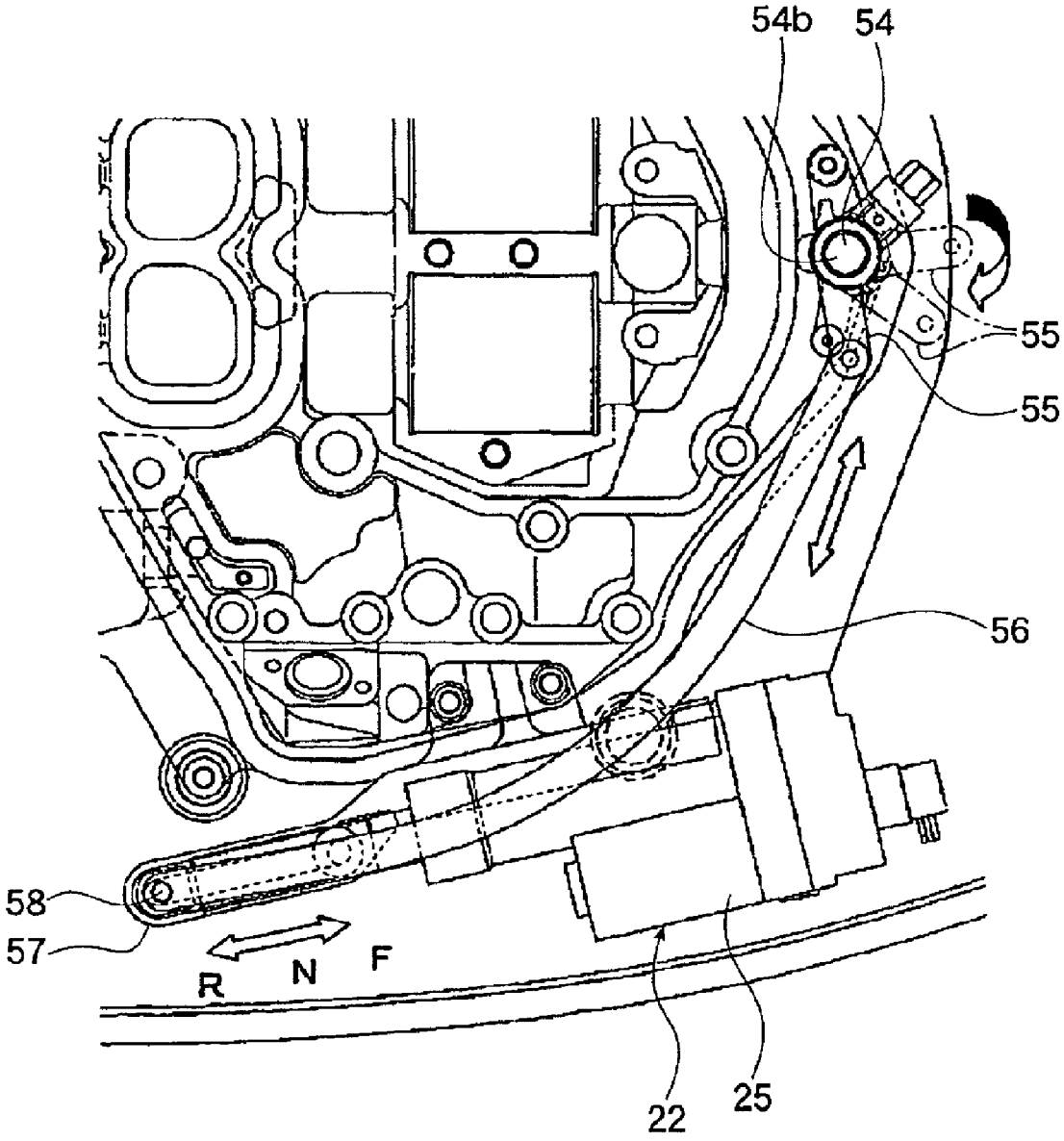
FIG. 4 is an enlarged top plan view of a shift actuator and certain associated components.

As shown in FIG. 4, which is a top plan view, a lever 55 can be fixed to an upper end portion 54*b* of the vertically-extending shift shaft 54. One end of a lever shift rod 56 can be rotatably coupled to a tip of the lever 55, and the other end of the lever shift rod 56 can be rotatably coupled to a slider 58. The slider 58 can be slidably disposed in a shift rail 57. When the shift actuator 22 causes the slider 58 to slide in a given direction, the shift shaft 54 can be rotated in a given direction through the lever shift rod 56 and the lever 55.

The shift actuator 22 can have a shift motor 25, which can be a DC motor serving as a drive source, a reduction gearing, and the like. However other types of actuators, motors and the like can also be used. The shift actuator 22 can be configured to drive the slider 58 in a given direction.

As shown in FIG. 6, the shift actuator 22 can have a shift position sensor 61 of a non-contact type. The shift position sensor 61 can be configured to detect a shift position (forward, neutral, or reverse position) and optionally a shift-operation speed. A signal provided from the shift position sensor 61 can be input to a controller, such as a control microcomputer 64, and the like, of the engine ECU 21.

For example, the shift position sensor 61 can be connected to the control microcomputer 64 by way of interface circuits 65 and 66, and also branched at a point between the interface circuit 65 and the control microcomputer 64 to thus be connected to the start-regulation circuit 68. Alternatively, the shift position sensor 61 may be branched at a point within the interface circuit 65 and connected to the start-regulation circuit 68.

The start-regulation circuit 68 can comprise a window comparator 69, a NOR circuit 70, an OR circuit 71, an AND circuit 72, a starter relay 73. The circuits 70 to 72 can be considered to be "semiconductor devices", as used herein.

One of two input terminals of the NOR circuit 70 can be connected to the shift position sensor 61 by way of the window comparator 69, and the other one of the input terminals can be connected to a cranking-permission/inhibition section of the control microcomputer 64. An output terminal of the NOR circuit 70 can be connected to one of two input terminals of the AND circuit 72.

One of two input terminals of the OR circuit 71 can be connected to the starting switch 75, and the other one of the input terminals can be connected to the cranking-permission/inhibition section of the control microcomputer 64. An output terminal of the OR circuit 71 can be connected to the other one of the input terminals of the AND circuit 72. The AND circuit 72 can be also connected to an exciting coil 73*a* of the starter relay 73. A normally-open contact 73*b* of the starter relay 73 can be connected to a starting motor 76 serving as a "starter" for starting the engine 30.

The window comparator 69 can be a sensing circuit for making a determination by reference to input voltage ranges which can be arbitrarily predetermined. As shown in FIG. 7, for example, when the shift position sensor 61 detects the neutral (N) position, a voltage within the range of 2 to 3 V can be input from the shift position sensor 61 to the window comparator 69, in response to which the window comparator 69 outputs a signal identified as "Lo".

When the shift position sensor 61 detects the forward (F) position or an N-F intermediate zone (a zone where a determination cannot be made due to crossing between the neutral and forward zones), a voltage within the range of 3 to 4.5 V can be input from the shift position sensor 61 to the window comparator 69, in response to which the window comparator 69 outputs a signal identified as "Hi". Put another way, the N-F intermediate zone (the zone where a definite determination can be difficult to make) is not determined as the neutral (N) position.

For a fail-safe range, a voltage of 4.5 V or higher can be input from the shift position sensor 61 to the window comparator 69, in response to which the window comparator 69 outputs a signal Hi.

When the shift position sensor 61 detects the reverse (R) position or an N-R intermediate zone (a zone where a determination cannot be made due to crossing), a voltage within the range of 0.5 to 2 V can be input from the shift position sensor 61 to the window comparator 69, in response to which the window comparator 69 outputs a signal Hi.

For another fail-safe range, a voltage of 0.5 V or lower can be input from the shift position sensor 61 to the window comparator 69, in response to which the window comparator 69 outputs a signal Hi.

As shown in FIG. 8, when the cranking-permission/inhibition section is in an initialized or a normal operation state, a signal Lo can be input to the NOR circuit 70, while a signal Hi can be input to the NOR circuit 70 in a cranking-inhibited state.

As shown in FIG. 10, when a cranking command is initialized or not issued, a cranking commanding section outputs a signal Lo to the OR circuit 71, while, when a cranking command is issued, the section outputs a signal Hi to the NOR circuit 71.

In operation, where the starting switch 75 is turned on from an engine-stopped state, the following four patterns of operation can be performed:

(1) when the shift lever 18 is in a position other than neutral (hereinafter called a "shift-in state") and the engine 30 is in gear, the starting motor 76 of the engine 30 can be inhibited from starting;

(2) when the shift lever 18 is in the neutral position and the engine 30 is in gear, the starting motor 76 of the engine 30 can be inhibited from starting;when the shift lever 18 is in the shift-in state and the engine 30 is in neutral, the starting motor 76 of the engine 30 can be allowed to start; and when the shift lever 18 is in the neutral position and the engine 30 is in neutral, the starting motor 76 of the engine 30 can be allowed to start.

As described above in patterns (1) and (2), in the state where the engine 30 is in gear, the starting motor 76 of the engine 30 can be inhibited from starting even when the starting switch 75 is turned on from an engine-stopped state. In contrast, as described above in patterns (3) and (4), in the state where the engine 30 is in neutral, the starting motor 76 of the engine 30 can be allowed to start when the starting switch 75 is turned on from the engine-stopped state.

Patterns (1) and (2) are described in greater detail below. As shown in FIG. 7, when the engine 30 is in gear (in the F, R, N-F or N-R intermediate zone), the shift position sensor 61 outputs an input voltage, other than the range of 2 to 3 V, to the window comparator 69; and a signal Hi is input from the window comparator 69 to one of the two input terminals of the NOR circuit 70. As shown in FIG. 8, the cranking-permission/inhibition section of the control microcomputer 64 outputs a signal Lo, corresponding to the "normal operation state," to the other one of the input terminals of the NOR circuit 70. In response thereto, the NOR circuit 70 outputs a signal Lo through its output terminal.

As shown in FIG. 11, when the starting switch 75 is turned on (SWON), a signal Hi is input to one of the two input terminals of the OR circuit 71; and a signal Lo is input to the other one of the input terminals of the OR circuit 71 from the cranking commanding section of the control microcomputer 64. The OR circuit 71 outputs a signal Hi through its output terminal.

As shown in FIG. 12, upon receipt of the signal Lo from the NOR circuit 70 and the signal Hi from the OR circuit 71, the AND circuit 72 outputs a signal Lo. Hence, since the exciting coil 73*a* of the starter relay 73 is not excited, the starter relay 73 remains in its open state where the starting motor 76 is not started. There is thus attained the control of inhibiting the engine 30 from starting even when the starting switch 75 is turned on from the engine-stopped state.

Next, patterns (3) and (4) will be described below. When the engine 30 is in neutral, upon receipt of an input voltage value supplied from the shift position sensor 61, the window comparator 69 outputs a signal Lo to one of the two input terminals of the NOR circuit 70. The cranking-permission/inhibition section of the control microcomputer 64 outputs a signal Lo to the other one of the input terminals of the NOR circuit 70. The NOR circuit 70 outputs a signal Hi through its output terminal (see FIG. 9).

When the starting switch 75 is turned on, a signal Hi can be input to the one of the two input terminals of the OR circuit 71. The cranking commanding section of the control microcomputer 64 outputs a signal Lo, corresponding to "cranking command not to be issued," to the other one of the input terminals of the OR circuit 71. In response thereto, the OR circuit 71 outputs a signal Hi through its output terminal (see FIG. 11).

As shown in FIG. 12, upon input of the signal Hi from the NOR circuit 70 and the signal Hi from the OR circuit 71, the AND circuit 72 outputs a signal Hi. Accordingly, the exciting coil 73*a* of the starter relay 73 excites the normally-open contact 73*b* to close the starter relay 73, thereby starting the starting motor 76. Thus, in a state where the engine 30 is in neutral, there can be attained the control of starting the engine 30 when the starting switch 75 is turned on from the engine-stopped state.

Meanwhile, when the control microcomputer 64 is set to the "cranking inhibited" state, the cranking-permission/inhibition section outputs a signal Hi to the one of the two input terminals of the NOR circuit 70, and the NOR circuit 70 outputs a signal Lo.

Upon receipt of the signal Lo, the AND circuit 72 inevitably outputs a signal Lo, which opens the starter relay 73, thereby inhibiting the starting motor 76 from starting. Hence, there can be attained the control of inhibiting the engine 30 from starting even when the starting switch 75 is turned on from the engine-stopped state.

Once the starting switch 75 is turned on, the cranking commanding section of the control microcomputer 64 can be set to an "cranking command to be issued" state, and the OR circuit 71 outputs a signal Hi. Accordingly, even when the starting switch 75 is of a button type, which maintains the on state while being depressed but turns off when released, the cranking commanding section can be set to the "cranking command to be issued" state, and the OR circuit 71 outputs the signal Hi. Therefore, even when the starting switch 75 is turned on and thereafter turned off, so long as the engine 30 is in neutral, the AND circuit 72 outputs a signal Hi. Hence, the starter relay 73 can be closed, thereby allowing the engine 30 to start.

In the above configuration, the start-regulation circuit 68 that deactivates the starting motor 76 of the engine 30 can be hardware circuitry having a plurality of logic circuits (the NOR circuit 70, and the like). Since the period of time required by the hardware circuitry from power-on to startup completion can be shorter than required by an equivalent configuration using software, the starting responsiveness to an operation with the starting switch 75 is improved.

In addition, utilization of the shift position sensor 61, which can be employed for use with the shift actuator 22 to move the gear to an arbitrary position, eliminates the need of disposing an additional device, such as a sensor, and thus achieves space saving. In other words, in some embodiments, the sensor 61 can be incorporated into the shift actuator 22, and can be configured to detect the movement of the slider 58. In some embodiments, the sensor 61 can be included in the motor 25. Some such motors, such as servo motors, normally include a sensor that can serve as the shift position sensor 61. However, such a sensor 61 can also be disposed in other locations. In such embodiments, there is no need for disposing a sensor in the lower unit of the outboard motor 11.

In addition, since the shift position sensor 61 can be of a non-contact type, durability can be improved, thereby enhancing reliability.

The shift position sensor 61 can be connected to the control microcomputer 64 by way of the interface circuit 65, and also branched at a point between the interface circuit 65 and the control microcomputer 64 to thus be connected to the start-regulation circuit 68. Accordingly, the interface circuit 65 can be simplified.

When the intermediate zone between the neutral and forward positions or that between the neutral and reverse positions are detected by the shift position sensor 61, the start-regulation circuit 68 determines that a position other than neutral is detected, and deactivates the engine 30 even when the starting switch 75 of the engine 30 is turned on. Since the engine 30 can be inhibited from starting in the intermediate range, the engine 30 can be protected from undesirable abrupt moving and the like, which may otherwise occur when the engine 30 is started in the intermediate range concurrently with gear engagement.

Furthermore, the control microcomputer 64 can have the cranking-permission/inhibition section that issues an instruction for permitting or inhibiting cranking. When the cranking-permission/inhibition section outputs a signal indicative of cranking inhibition to the start-regulation circuit 68, the cranking-permission/inhibition section deactivates the engine 30 by way of the start-regulation circuit 68. Since cranking inhibition by the control microcomputer 64 and that by the start-regulation circuit 68 can coexist, the circuit can be realized with a simple configuration.

The control microcomputer 64 can be disposed at or in the engine ECU 21 and can be configured to perform the above-described functions using, for example, software modules. However, other configurations can also be used.

The engine ECU 21 can also include the logic circuits, which can be semiconductor devices of the start-regulation circuit 68 and which are connected to the starting switch 75 of the engine 30. Since determination on starting can be made in the engine ECU 21, wiring can be simplified, thereby reducing the number of connections in the outboard motor 11, and enhancing reliability.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A watercraft propulsion system having an engine configured to produce thrust under control of a remote controller that remotely controls shifting between forward, neutral, and reverse modes, the watercraft propulsion apparatus comprising a shifting mechanism configured to shifting gears between forward, neutral, and reverse gears, a shift actuator configured to drive the shifting mechanism, a shift position sensor configured to detect a position of the shift actuator with respect to the forward, neutral, and reverse gears, a controller configured to control the shift actuator in accordance with a signal provided from the shift position sensor, and a start-regulation circuit including a plurality of semiconductor devices, the circuit being configured to deactivate a starter of the engine when a starting switch of the engine is turned on in a state where a position other than neutral is detected by the shift position sensor, wherein the start-regulation circuit is configured to deactivate the starter of the engine even when the starting switch of the engine is turned on, when an intermediate zone between the neutral and forward positions or an intermediate zone between the neutral and reverse positions is detected by the shift position sensor, and when the start-regulation circuit determines that a position other than neutral is detected.

2. The watercraft propulsion apparatus according to claim 1, wherein the shift position sensor is of a non-contact type.

3. The watercraft propulsion apparatus according to claim 2, wherein the shift position sensor is connected to the controller with an interface circuit, and the shift position sensor is connected to the start-regulation circuit at a branched point within the interface circuit or a point between the interface circuit and the controller.

4. The watercraft propulsion apparatus according to claim 1, wherein the shift position sensor is connected to the controller with an interface circuit, and the shift position sensor is connected to the start-regulation circuit at a branched point within the interface circuit or a point between the interface circuit and the controller.

5. The watercraft propulsion apparatus according to claim 4, wherein the start-regulation circuit is configured to deactivate the starter of the engine even when the starting switch of the engine is turned on, when an intermediate zone between the neutral and forward positions or an intermediate zone between the neutral and reverse positions is detected by the shift position sensor, and when the start-regulation circuit determines that a position other than neutral is detected.

6. The watercraft propulsion apparatus according to claim 4, wherein the controller comprises a cranking-permission/inhibition section that is configured to issue an instruction for permitting or inhibiting cranking and wherein the start-regulation circuit is configured to deactivate the starter of the engine when a signal indicative of cranking inhibition is provided from the cranking-permission/inhibition section to the start-regulation circuit.

7. The watercraft propulsion apparatus according to claim 4, wherein the controller is included in an engine ECU, the engine ECU comprising a logic circuit including the semiconductor devices in the start-regulation circuit, the logic circuit being connected to the starting switch of the engine.

8. The watercraft propulsion apparatus according to claim 4, wherein the start-regulation circuit comprises a plurality of logic circuits formed with a passive element, and a starter relay configured to operate depending on an output from the logic circuits, the starter relay being configured to be operated, in a state where a position other than neutral is detected by the shift position sensor, in accordance with outputs from the plurality of logic circuits, thereby deactivating the starter of the engine even when the starting switch of the engine is turned on.

9. The watercraft propulsion apparatus according to claim 1, wherein the controller is included in an engine ECU, the engine ECU comprising a logic circuit including the semiconductor devices in the start-regulation circuit, the logic circuit being connected to the starting switch of the engine.

10. The watercraft propulsion apparatus according to claim 1, wherein the controller is included in an engine ECU, the engine ECU comprising a logic circuit including the semiconductor devices in the start-regulation circuit, the logic circuit being connected to the starting switch of the engine.

11. The watercraft propulsion apparatus according to claim 1, wherein the start-regulation circuit comprises a plurality of logic circuits formed with a passive element, and a starter relay configured to operate depending on an output from the logic circuits, the starter relay being configured to be operated, in a state where a position other than neutral is detected by the shift position sensor, in accordance with outputs from the plurality of logic circuits, thereby deactivating the starter of the engine even when the starting switch of the engine is turned on.

12. The watercraft propulsion apparatus according to claim 11, wherein a sensing circuit is interposed between the shift position sensor and the logic circuit in the start-regulation circuit, the sensing circuit being configured to discriminate between a neutral position and a position other than neutral on the basis of an input voltage value supplied from the shift position sensor by referring to a predetermined input voltage range, and configured to output a signal to the logic circuit.

13. The watercraft propulsion apparatus according to claim 1 in combination with a watercraft, the watercraft propulsion apparatus being mounted to the watercraft and configured to produce thrust for the watercraft.

14. The watercraft propulsion apparatus according to claim 1, wherein the controller comprises a microcomputer configured to run software to control the shift actuator in accordance with a signal provided from the shift position sensor.

15. A watercraft propulsion system having an engine configured to produce thrust under control of a remote controller that remotely controls shifting between forward, neutral, and reverse modes, the watercraft propulsion apparatus comprising a shifting mechanism configured to shifting gears between forward, neutral, and reverse gears, a shift actuator configured to drive the shifting mechanism, a shift position sensor configured to detect a position of the shift actuator with respect to the forward, neutral, and reverse gears, a controller configured to control the shift actuator in accordance with a signal provided from the shift position sensor, and a start-regulation circuit including a plurality of semiconductor devices, the circuit being configured to deactivate a starter of the engine when a starting switch of the engine is turned on in a state where a position other than neutral is detected by the shift position sensor, wherein the controller comprises a cranking-permission/inhibition section that is configured to issue an instruction for permitting or inhibiting cranking and wherein the start-regulation circuit is configured to deactivate the starter of the engine when a signal indicative of cranking inhibition is provided from the cranking-permission/inhibition section to the start-regulation circuit.

16. A watercraft propulsion system having an engine configured to produce thrust under control of a remote controller that remotely controls shifting between forward, neutral, and reverse modes, the watercraft propulsion apparatus comprising a shifting mechanism configured to shifting gears between forward, neutral, and reverse gears, a shift actuator configured to drive the shifting mechanism, a shift position sensor configured to detect a position of the shift actuator with respect to the forward, neutral, and reverse gears, a controller configured to control the shift actuator in accordance with a signal provided from the shift position sensor, and a start-regulation circuit including a plurality of semiconductor devices, the circuit being configured to deactivate a starter of the engine when a starting switch of the engine is turned on in a state where a position other than neutral is detected by the shift position sensor, wherein the start-regulation circuit comprises a plurality of logic circuits formed with a passive element, and a starter relay configured to operate depending on an output from the logic circuits, the starter relay being configured to be operated, in a state where a position other than neutral is detected by the shift position sensor, in accordance with outputs from the plurality of logic circuits, thereby deactivating the starter of the engine even when the starting switch of the engine is turned on.

17. A watercraft propulsion system having an engine configured to produce thrust under control of a remote controller that remotely controls shifting between forward, neutral, and reverse modes, the watercraft propulsion apparatus comprising a shifting mechanism configured to shifting gears between forward, neutral, and reverse gears, a shift actuator configured to drive the shifting mechanism, a shift position sensor configured to detect a position of the shift actuator with respect to the forward, neutral, and reverse gears, a controller configured to control the shift actuator in accordance with a signal provided from the shift position sensor, and a start-regulation circuit including a plurality of semiconductor devices, the circuit including means for deactivating a starter of the engine even when the starting switch of the engine is turned on and an intermediate zone between the neutral and forward positions or an intermediate zone between the neutral and reverse positions is detected by the shift position sensor, and when the start-regulation circuit determines that a position other than neutral is detected.

* * * * *